United States Patent [19]

DeMarco et al.

[11] Patent Number: 4,764,757

[45] Date of Patent: Aug. 16, 1988

[54] SECURITY DETECTION AND LOCATION SYSTEM WITH INDEPENDENT LOCAL ALARM AND COMMUNICATIONS CIRCUITS

[76] Inventors: Frank G. DeMarco, 11171 NW. 36th Ct., Coral Springs, Fla. 33065; Dennis D. DeMarco, 1905 NW. 78th Ave., Margate, Fla. 33063

[21] Appl. No.: 25,051

[22] Filed: Mar. 12, 1987

[51] Int. Cl.[4] ..... G08B 25/00

[52] U.S. Cl. ..... 340/574; 340/539; 340/693

[58] Field of Search ..... 340/574, 539, 693

[56] References Cited

U.S. PATENT DOCUMENTS

| | | | |
|---|---|---|---|
| 3,205,482 | 9/1965 | Taylor, Jr. et al. | 340/693 |
| 3,449,738 | 6/1969 | Chesnul et al. | 340/691 |
| 4,001,805 | 1/1977 | Golbe | 340/527 |
| 4,288,784 | 9/1981 | Fusco | 340/539 |
| 4,446,454 | 5/1984 | Pyle | 340/521 |
| 4,692,742 | 9/1987 | Raizen et al. | 340/539 |

*Primary Examiner*—Glen R. Swann, III
*Attorney, Agent, or Firm*—John Cyril Malloy

[57] ABSTRACT

The security detection and location system includes a plurality of monitoring stations that are spaced from each other. Each monitoring station includes its own solar rechargeable battery, a receiver, an alarm circuit and a communications device such as a telephone dialer or a radio frequency (RF) transmitter. The security system operates in conjunction with a plurality of portable transmitters that can be actuated to transmit a distress signal by a person carrying one of the transmitters. When the portable transmitter issues a distress signal, the receiver in a monitoring station issues a command signal which activates two independent circuits, the alarm circuit and the communications circuit. The alarm circuit generates an audible sound in the locale of the monitoring station and the communications circuit sends a signal unique to that monitor to a central response or control unit.

9 Claims, 2 Drawing Sheets

SECURITY DETECTION AND LOCATION SYSTEM WITH INDEPENDENT LOCAL ALARM AND COMMUNICATIONS CIRCUITS

BACKGROUND OF THE INVENTION

The present invention relates to a security system and particularly relates to a system which detects a distress signal transmitted in the locale of a monitoring station and communicates with a central response unit thereby to provide an indiction of the location of the security matter.

In one prior art system described in U.S. Pat. No. 4,189,721 to Doell, a portable transmitter activated a receiver disposed in a stationary monitor unit. The monitoring unit was coupled to an alternating current (ac) power source. The power from the ac power source was stepped down in a transformer and the output of the transformer was switched by a relay activated by the receiver. Upon closing the output circuit of the transformer, a second relay was activated which coupled the ac power to a third relay which in turn activated an audio alarm from the monitoring station. This prior art security system was reset after activation by a manual switch interposed between the ac power source and the audio alarm.

OBJECTS OF THE INVENTION

This is an object of the present invention to provide a security system which detects a distress signal and provides an indication of the location of the distress signal.

It is another object of the present invention to provide a plurality of monitoring units each with their own power source.

It is a further object of the present invention to utilize solar power to recharge batteries in the individual monitoring unit.

It is an additional object of the present invention to send out a detection signal upon receipt of the signal and to generally a humanly recognizable alarm in the immediate vicinity of the monitoring means upon receipt of the signal.

It is another object of the present invention to provide a plurality of portable mechanisms that are capable of issuing distress signals in a region having a plurality of monitoring units dispersed throughout.

A further object of the present invention is to utilize two independent circuits, an alarm and a communication circuit, in the security system to enhance the effectiveness and provide an additional degree of security to the entire system.

SUMMARY OF THE INVENTION

The security detection and location system includes a plurality of monitoring stations that are spaced from each other in a wide geographic region. Each monitoring station includes its own solar rechargeable battery, a receiver, an alarm circuit and a communications device such as a telephone dialer, signaler or a radio frequency (RF) transmitter. The security system operates in conjunction with a plurality of portable transmitters; each portable transmitter can be actuated to transmit a distress signal.

When the portable transmitter issues a distress signal, and if the portable transmitter is within the region, the receiver in at least the closest monitor is activated. The receiver issues a command signal which couples the two independent circuits, the alarm circuit and the communications circuit, to the power source in the monitor unit. The alarm circuit generates an audible sound and also generates a visible alarm. The communications circuit sends a signal unique to that monitor to a central response unit. In one embodiment, the monitoring unit issues a detection signal over telephone lines which connect each monitoring unit with the central response unit. In another embodiment, the communications circuit generates an RF signal and the central response unit receives that RF signal with an appropriate RF receiver. In either case, since the detection signal (either the signal over the phone lines or the RF signal) is unique to a particular monitoring unit, the central response unit can therefore respond to the security in an appropriate fashion.

BRIEF DESCRIPTION OF THE DRAWING

Further objects and advantages of the present invention may be found in the detailed description of the invention taken in conjunction with the accompanying drawings in which.

DETAILED DESCRIPTION OF THE INVENTION

The present invention relates to a security system which detects and locates a distress signal emitted by a portable transmitter.

Figure 1:
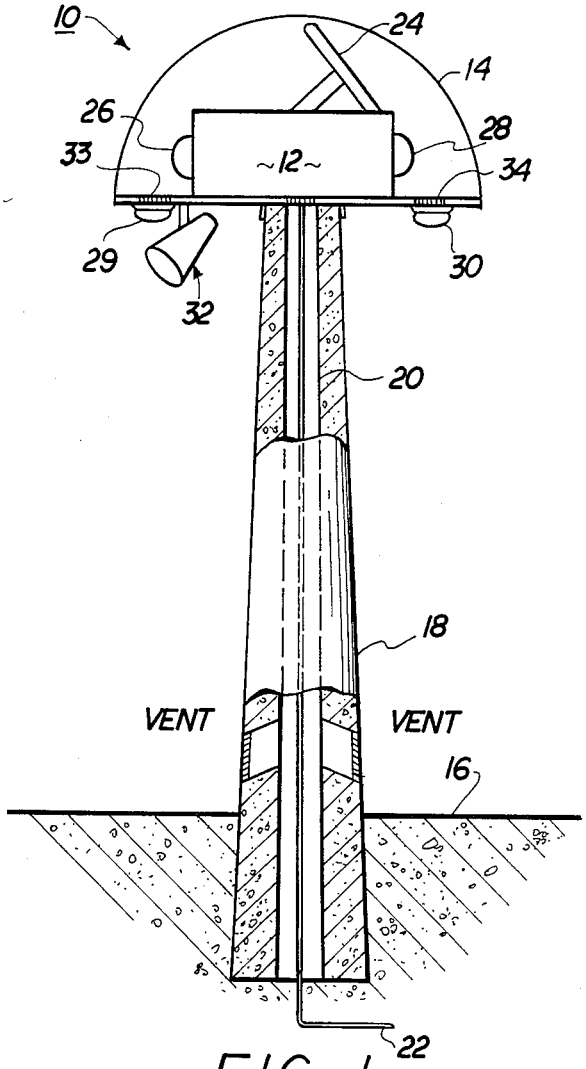
FIG. 1 schematically illustrates the monitoring unit in accordance with the principles of the present invention.

FIG. 1 schematically illustrates monitor unit 10 having internal circuitry 12 that is mounted in a semi-hemispherical dome 14. Dome 14 is mounted at an elevation above the ground and in one embodiment is elevated 15 feet above ground 16. Pole 18, in one embodiment, is an 18 foot concrete pole which has a hollow bore 20 therethrough. A telephone line 22 extends through the bore 20 and is connected to circuitry 12 within dome 14. The circuitry includes a rechargeable battery which is recharged by solar panel 24. In one embodiment, solar panel 24 faces a southernly direction. The monitoring unit also includes various visual and audio alarms such as strobe lights 26, 28, 29 and 30 (the last two strobe lights being respectively blue and red). Also, horn 32 is attached to the underside of dome 14 and provides an audible alarm. The dome also includes four vents, two of which are shown as vents 32 and 34. Each vent is screened to limit entrance to the interior of dome 14.

Figure 2:
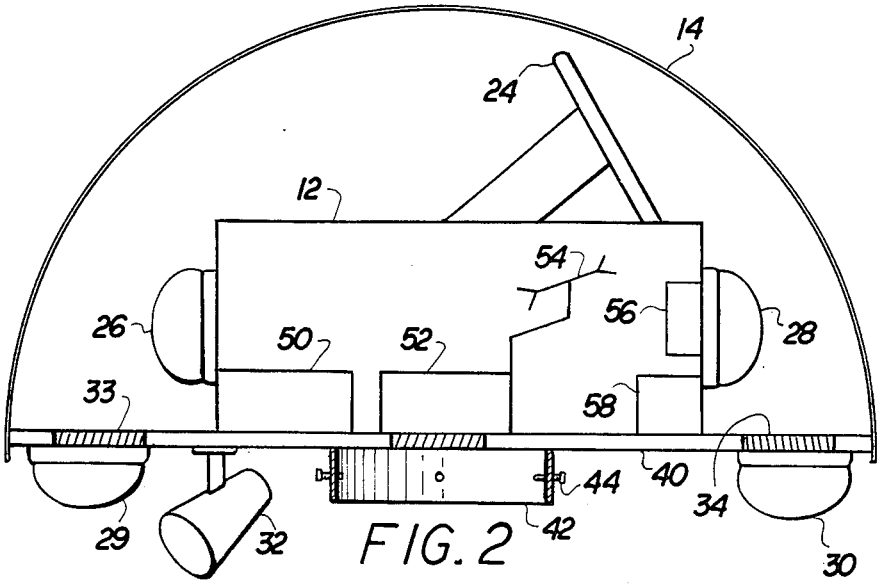
FIG. 2 schematically illustrates the internal components of the monitoring unit.

FIG. 2 shows in greater detail the interior of dome 14 and particularly shows ingreater detail the electronic components within monitoring circuit 12 of FIG. 1. Dome 14 is one-quarter inch Lexon TM plastic that is opaque white. The plastic admits light but components in the interior of the dome are not visible due to the opaqueness of the plastic. In FIG. 2, similar numerals designating similar items are carried forward from FIG. 1. In FIG. 2, strobe lights 26 and 28 are identified as white strobe lights. Strobe Lights 29 and 30 are mounted below circular plate 40 and the plate also provides a base for monitor circuitry 12. Dome 14 and plate 40 are mounted on pole 18 (shown in FIG. 1) by collar 42 that fits about the upper portion of the pole. The pole is affixed to the collar by a plurality of spaced screws one of which is identified as screw 44.

The major components of monitoring circuit 12 are shown in FIG. 2 as communications device 50, receiver 52 that is connected to antenna 54, tone generator 56 and battery 58. The interconnection of these various components is not shown in FIG. 2, but is better shown in FIG. 3.

Figure 3:
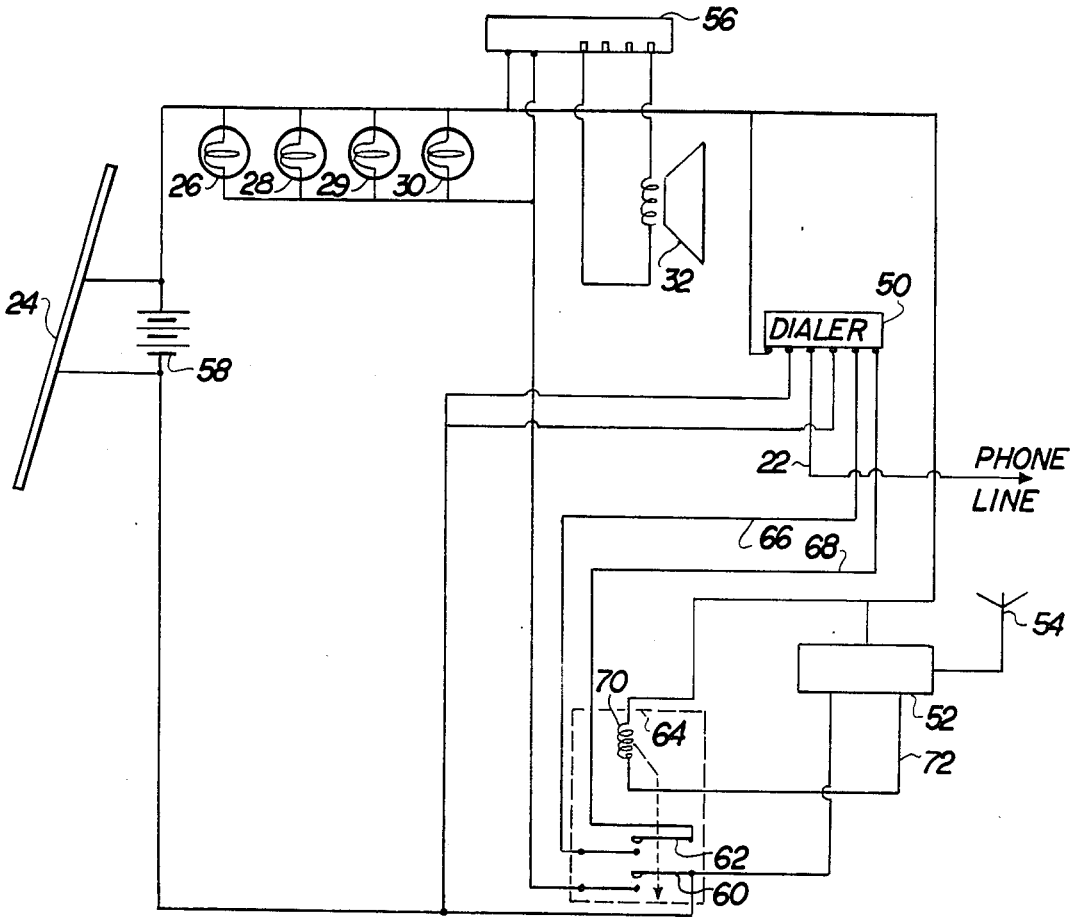
FIG. 3 is an electrical schematic of the monitoring unit.

FIG. 3 is an electrical schematic of one embodiment of the present invention. Again, similar numbers are carried forward from FIGS. 1 and 2 to designate similar items. Battery 58 in this embodiment is a 12 volt battery which is trickle charged by photovoltaic solar panel 24. In the embodiment, battery 58 produces 16 amperes of current and is a three year, rechargeable, gel battery. The negative terminal of the battery is the system ground which is coupled to communications device 50. The communications device is a dialer or a transmitter. The system ground is connected to device 50, to receiver 52 and to normally open contact arm 60 of relay 64 shown within the dashed box. The other contact arm 62 of relay 64 closes a circuit loop of control lines 66 and 68 of communications device 50. In one embodiment, the communications device is a telephone dialer that is coupled to phone line 22. In this embodiment, the dialer is coupled to the negative 12 volt ground and to the equipment ground. The dialer is also coupled to the positive 12 volt line at its terminal furthest to the left. Simiarly, tone generator 56 is coupled to the positive 12 volt line as are strobe lights 26, 28, 29 and 30. Horn 32 is coupled to tone generator 56 via its coil.

Returning to relay 64, one side of relay coil 70 is coupled to the positive 12 volt power line while the other side of coil 70 is coupled to line 72 that carries the actuation or command control signal from receiver 52. No current flows through coil 70 via line 72 unless the receiver is activated and therefore contacts 60 and 62 of relay 64 are normally open.

Figure 4:
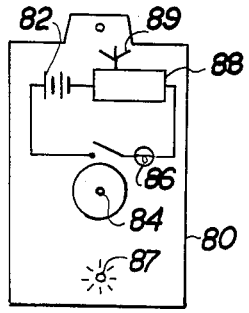
FIG. 4 schematically illustrates the portable transmitter in accordance with the principles of the present invention; and, FIG. 5 schematically illustrates a plurality of monitoring units, the portable transmitter and the central monitor station in accordance with the principles of the present invention.

The monitoring stations operate in conjunction with a portable transmitter shown in FIG. 4. Portable transmitter 80 is carried by a person. Transmitter 80 includes a 12 volt alkaline batter 82, a push button switch 84, a light emitting diode (LED 86 whose light is shown at item 87) and a transmitting circuit 88 having antenna 89. In one embodiment, the portable transmitters are commercially available, Linear transmitters, model number ET-1.

The security system operates as follows. When a person depresses push button switch 84 on portable transmitter 80, LED 87 is activated and a radio frequency distress signal is transmitter from the portable transmitter. If the transmitter 80 is within a security region defined by the receiving range of a plurality of monitoring units, receiver 52 (FIG. 3), in the nearest monitoring station, is activated and if the distress signal is present for 1 second, receiver 52 connects line 72 to the common equipment ground of negative 12 volts and current flows through coil 70 of relay 64. This energization closes contacts 60 and 62. The closure of contact 60 links the common negative 12 volt ground to tone generator 56 as well as to strobe lights 26, 28, 29 and 30. Therefore, the lights and horn are activated in the immediated locale of the activated monitoring station. In one embodiment, tone generator 56 generates a 120 Db. sound as a combination of three separate siren sounds. The tone generator cycles through each siren sound for a period of five minutes. The tone generator in this embodiment is a Moose model number MPI-23.

The closure of contact 62 completes the loop of control lines 66 and 68 and activates communications device 50 completely independently of the local alarm generated by the monitoring station. In one embodiment, communications device 50 is the telephone dialer which automatically dials a predetermined telephone number and establishes a telecommunications link over telephone lines 22 to a central response or control station. The dialer can also be configured to repeatedly generate over the telephone lines an identification code unique to that monitoring unit once the telecommunications link is established. This code identifies which monitoring unit out of the plurality of monitoring units in the security region is activated by the distress signal from portable transmitter 80.

Receiver 52 has three timing circuits. One timing circuit determines whether a distress signal (the RF signal transmitted from portable transmitter 80) is continuous and present for a predetermined period of time (approximately one second in the preferred embodiment), another timing circuit that times the linkage to common ground (negative 12 v) of line 72 after detection of the distress signal (which in a preferred embodiment is five minutes), and a third timing circuit which is utilized to test the monitoring station and which couples line 72 to the common ground for forty seconds.

Receiver 52 is a Linear Rf receiver model number D-67, sold by Linear of Calsbad, Calif. The dialer and receiver 52 utilize 250 milliamperes when those components are in a quiescent or non-activated state. The circuits are in the nonactivated state in the absence of any distress signal from the portable transmitter.

Figure 5:
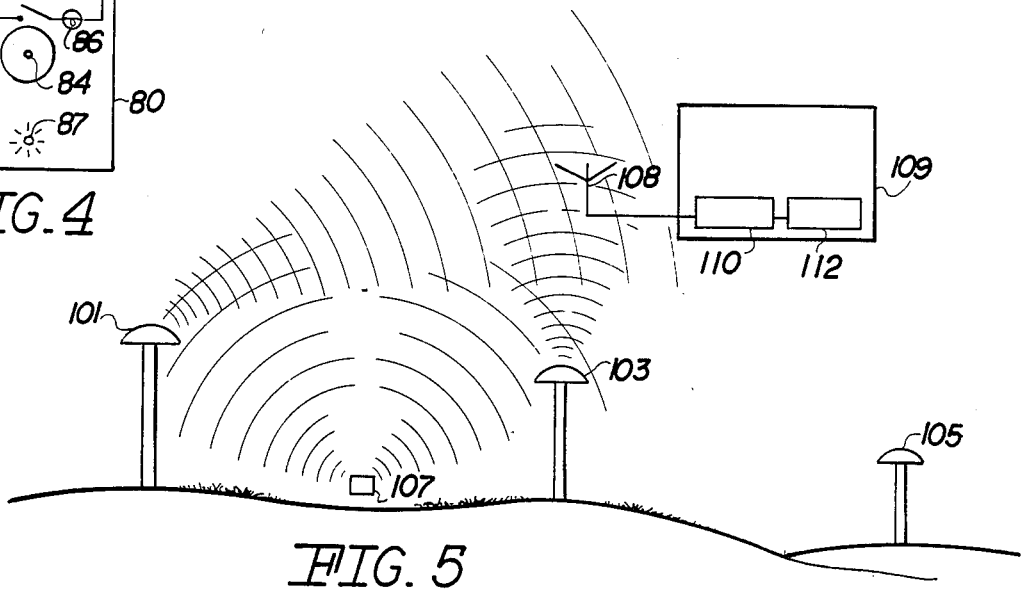

FIG. 5 schematically illustrates a security system with a plurality of monitoring stations identified as stations 101, 103 and 105 dispersed throughout a security region. Portable transmitter 107 is issuing a distress signal and monitoring stations 101 and 103 receive that signal since the transmitter is within the range of those stations. In this embodiment, the monitoring stations have a transmitter as communications device 50 and each monitoring station has a unique transmission frequency. Particularly, station 103 transmits frequency at $f_1$, and station 101 transmit at frequency $f_2$. These transmission frequencies are generally in the 900 MHz range. A central monitor station 109 (central response unit) receives the RF signals $f_1$ and $f_2$ via antenna 108. Receiver 110 decodes these frequency signals and a location circuit 112 determines the location of portable transmitter 107 by associating the unique frequencies $f_1$ and $f_2$ to the particular monitoring stations. A more precise determination of the location of transmitter 107 can be obtained by triangulation of the RF signals which is known to persons of ordinary skill of the art.

It is estimated that the range of monitoring stations is between 150 and 200 feet. It is further estimated that up to 10,000 monitoring stations could be used per central monitor station. Of course, personnel at the central monitor station, after detecting the signal from the remote monitoring station, could call the police, the fire department, or other security service to inventigate the distress signal.

In one embodiment, strobe lights 26, 28, 29 and 30 each generate 1,000,000 candle light power.

Since each monitoring station can be completely self-sufficient when used with a communications device such as an RF transmitter, the security system in accordance with the present invention can be easily installed and maintained in a designated security region. Individuals can be given the portable transmitters and these transmitter can be activated if anything unusual happens to that person. The transmitters could be activated due to the poor health of the person, for example if the person has a heart attack, or if a crime was about to be committed.

The claims appended hereto are meant to cover modification in changes of the present invention in accordance with the principals of the invention as discussed above.

What we claim is:

1. A security detection and location system comprising:

a portable control means for transmitting a distress signal;

a plurality of stationary monitoring means disposed in spaced relation to one another along a monitored area for monitoring the transmission of a detection signal, each monitoring means including:

a self contained power source, a receiver means coupled to said power source for receiving said distress signal and for generating an activation command signal and means for issuing a detection signal in the presence of said activation command signal;

a local alarm generating means for generating a recognizable alarm approximate a respective one of said pluraltiy of monitoring means in the present of said activation command signal; each of said monitoring means including relay means for independently coupling said power source to said detection signal issuing mean and said local alarm generating means such that a failure of either one thereof does not affect the other one thereof; the detection signal issuing means an the local alarm generating means being independent of each other;

a central response unit remote from said plurality of monitoring means and including recognizing means for recognizing the detection signal from any one of said plurality of monitoring means and wherein said detection signal is indicative of a location of said portable control means, and each of said plurality of monitoring means having a unique detection signal and wherein one or more of said plurality of monitoring means may concurrently communicate with said central processing unit when said distress signal from said portable control means is recieved by one or more of said monitoring means.

2. A security system as claimed in caim 1 including means for establishing a telecommunications link between said detection signal issuing means and the recognition means of said central response unit.

3. A security system as claimed in claim 2 wherein said detection signal issuing means is an automatic dialing means and said means for establishing a telecommunications link is a telephone link and the recognition means is a means for receiving said detection signal over said telephone link and generating a central alarm signal indicative of said security matter.

4. A security system as claimed in claim 1 wherein said local alarm generating means produces an audio and a visual alarm in the presence of said activation command.

5. A security system as claimed to claim 1 wherein said detection signal issuing means includes a radio frequency transmitter that transmits an RF signal as said detection signal and wherein said means for recognizing said detection signal in said central response unit includes an RF receiver means for receiving said RF signal and means for generating a response.

6. A security system as claimed in claim 1 wherein said receiver means includes means for delaying said activation command signal unit said distress signal is received substantially continuously or a predetermined period of time.

7. A security system as claimed in claim 6 wherein said receiver means includes a time-out means for generating and holding said activation command signal for predetermined time after delay by said means for delaying.

8. A security system as claimed in claim 1 wherein said power source is a rechargeable battery and said monitoring means includes a solar activated battery recharging means coupled to said rechargeable battery.

9. A security system as in claim 1 wherein each of said plurality of monitoring means comprises a dome housing secured to an upper end of an elongated, elevated support.

* * * * *